United States Patent [19]

Croyle

[11] 4,280,425

[45] Jul. 28, 1981

[54] METHOD AND APPARATUS FOR ELECTRO-PNEUMATIC CONTROL OF A STITCHING MACHINE

[75] Inventor: Gene F. Croyle, Knoxville, Tenn.

[73] Assignee: PCE Corporation, Knoxville, Tenn.

[21] Appl. No.: 56,008

[22] Filed: Jul. 9, 1979

[51] Int. Cl.[3] ..... D05B 69/00; D05B 19/00

[52] U.S. Cl. ..... 112/272; 112/121.11; 112/DIG. 3; 112/262.1

[58] Field of Search ..... 112/272, 275, 277, 121.11, 112/DIG. 3, 262.1

[56] References Cited

U.S. PATENT DOCUMENTS

| | | | |
|---|---|---|---|
| 2,856,873 | 10/1958 | Abel | 112/121.11 X |
| 3,187,702 | 6/1965 | Freeman et al. | 112/272 |
| 3,599,585 | 8/1971 | Myrick | 112/272 X |
| 3,760,748 | 9/1973 | Rockerath | 112/272 X |
| 3,799,084 | 3/1974 | Furnari | 112/121.11 |

*Primary Examiner*—Peter P. Nerbun

*Attorney, Agent, or Firm*—Luedeka & Fitch

[57] ABSTRACT

Method and apparatus for electro-pneumatic control of a stitching machine, operable either in the automatic or semiautomatic mode. Following initiation of a stitching operation through actuation of the present control system, the system internally of itself develops a plurality of interlocks that require the existence of selected conditions for continuation of normal machine operations and which respond to abnormal conditions by precluding machine operation past preselected termination points. Thread conservation is a principal benefit.

6 Claims, 7 Drawing Figures

R8
LED1
Q1
R9
R10
R11
C11
U7
U2A
U2B
U1C
R7
R5
R6
U1B
R4
P1
R3
C1
R2
U1A
R1
J1
SP1
PC1
LED5
SP2
J2
R12
12 V D.C.
R16
P2
C3
U6
Q2
R15
C6
C7
R26
R14
C2
U5
C5
R13
C4

METHOD AND APPARATUS FOR ELECTRO-PNEUMATIC CONTROL OF A STITCHING MACHINE

This invention relates to the control over the operation of a stitching machine, and particularly to a method and apparatus for controlling a stitching machine in a manner to conserve thread.

In recent years due to inflation and consequential cost awareness, the stitching departments of textile companies have become greatly concerned with the amount and cost of thread wasted by stitching machine operators. Since most operators are on a piece rate, they tend to start their machines long before the work piece is in position for sewing and they tend to run the piece a long distance past the needle following completion of the stitching operation so that it becomes easier to clip the thread. The end result is a tremendous amount of thread waste and unnecessary expense.

Other factors contributing to the amount of thread waste are the reaction times of the operators and the speed of the machines. Some modern machines stitch as fast as 8 to 10 inches per second using multiple needles for chain stitching, serging and other complex stitching and have as many as 6 spools of thread feeding them. If the operator hesitates for even half a second in stopping the machine after the stitching operation is completed, she may run out as much as four or five inches of dual chain stitching which, when unraveled, could be over a foot long with each chain made up of three or four separate threads. Also, when the machine is operated without material under the presser foot a severe stress is placed upon the moving parts due to metal to metal contact. When all of the above factors are combined, the net result is a tremendous cost in thread waste and machine wear.

Attempts have been made to design a control system to monitor and reduce thread waste but the general opinion of the industry is that none of the systems has worked satisfactorily and that they have required a great amount of maintenance. Most of the design attempts to data are totally air operated and use pneumatic sensing devices to detect when the work piece is in position. This type system automatically operates the machine's treadle and when the sensor detects a work piece in position, the machine is turned on at maximum speed. Lint generated when the fabric material passes under the presser foot, regularly clogs the pneumatic sensor, which causes the machine to "sense" a work piece to be in position, causing the machine to go out of control and run continuously. These air devices are slow in reacting and timing is accomplished using devices that are sensitive to common air line contaminants and other factors which affect their repeat timing accuracy. The operator has no control of speed nor the ability to stop the machine once it has started. An inexperienced operator is not able to keep up with the machine while learning to operate it and as a result many work pieces are ruined in the training process.

A major problem with many known types of prior systems that were intended to reduce thread waste has been that the operator can defeat the system by any one of a number of methods. One such method is turning off the air supply to the control circuit. Other gimmicks used by operators include plugging an air jet with chewing gum or taping over the detector means. This latter gimmick is often employed with photoelectric detection systems.

In one prior art system for conserving thread in a stitching operation there is provided a photoelectric cell-type detector system at the rear of the presser foot of a stitching machine to detect the completion of the stitching operation. The signal developed by the photoelectric cell in this prior art system is employed to activate an electromagnetic device that incapacitates the common treadle of a stitching machine so that the operator cannot continue the stitching operation past the time when the trailing edge of the work product has passed under the presser foot and between the photoelectric cell and its detector component. This type system is one of the easiest for the operator to defeat by merely blocking off the photoelectric cell. Further, in this prior art system, the operator can start the machine long before the work piece is ready to be placed under the presser foot, thereby wasting thread at the beginning of a stitching operation. Such a system is shown in U.S. Pat. No. 3,187,702.

It is therefore an object of the present invention to provide an improved method and apparatus for the controlling of a stitching machine wherein there is a maximum conservation of thread. It is another object to provide a method and apparatus for controlling a stitching machine wherein the control is not readily defeatable by an operator. It is another object to provide a method and apparatus for controlling a stitching machine which will substantially troubleshoot itself. It is another object of the invention to provide a method and apparatus for controlling a stitching machine wherein the cycle and sequence times employed therein are adjustable. Other objects and advantages of the invention will be apparent from the following description of the invention, including the drawings in which:

Figures 4, 4A, 4B:
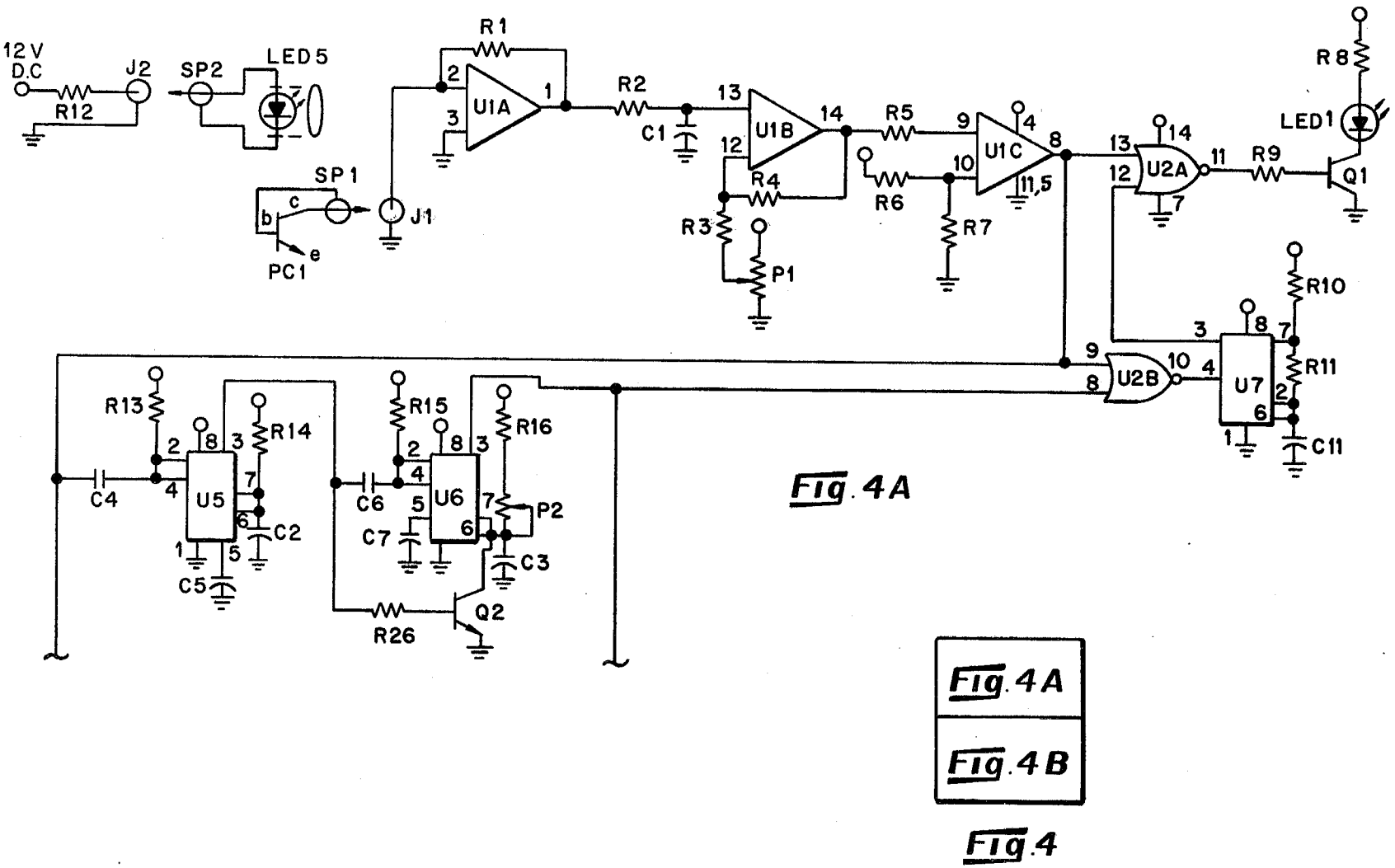
Figure 4B:
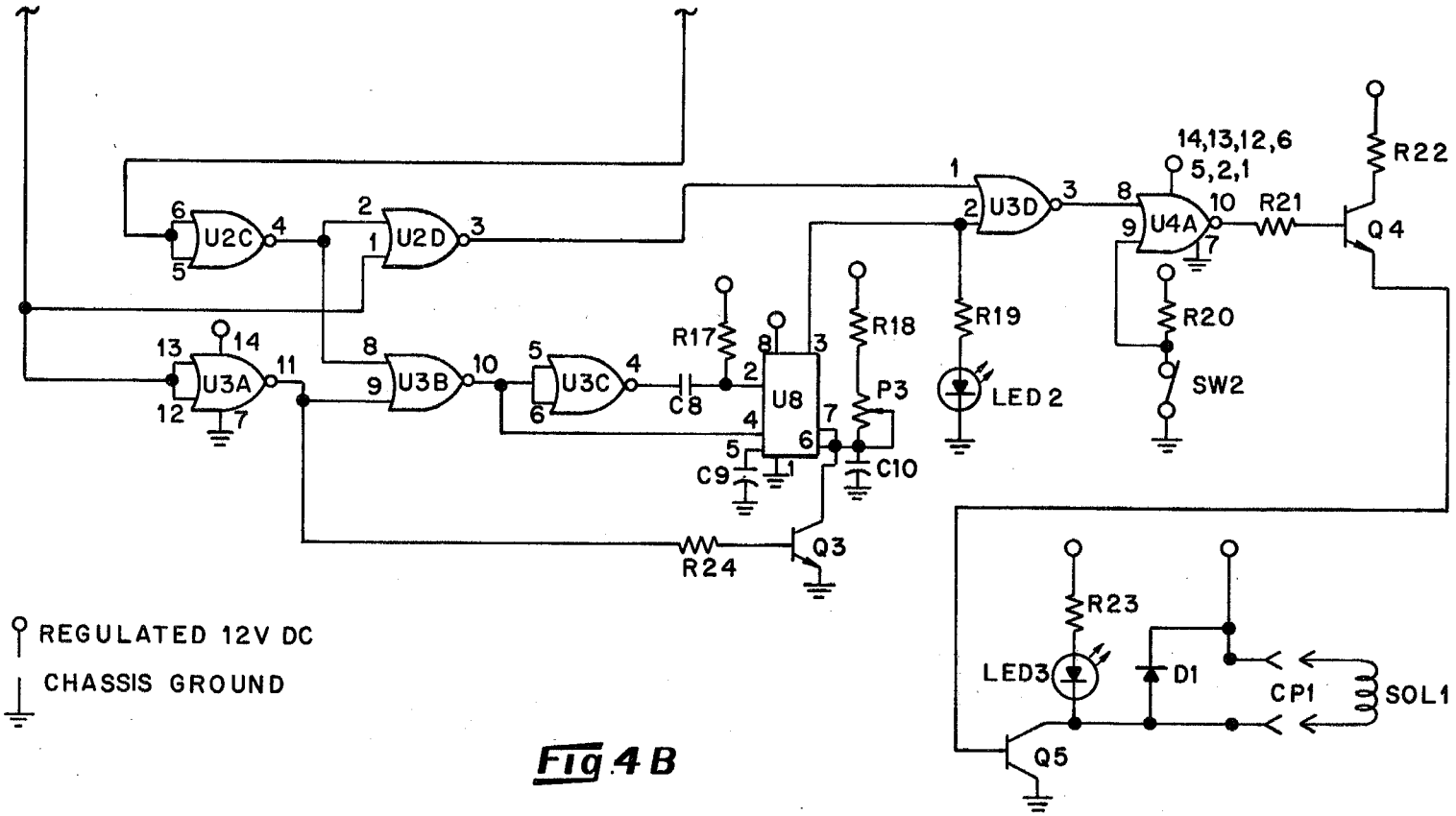
Figure 5:
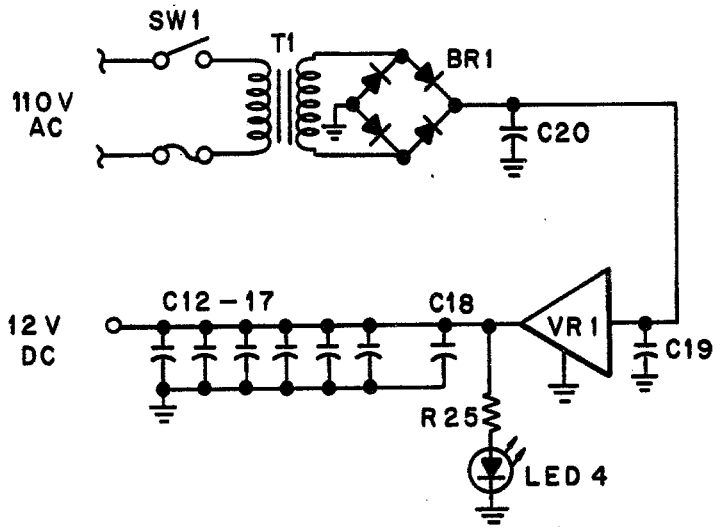
Figure 6:
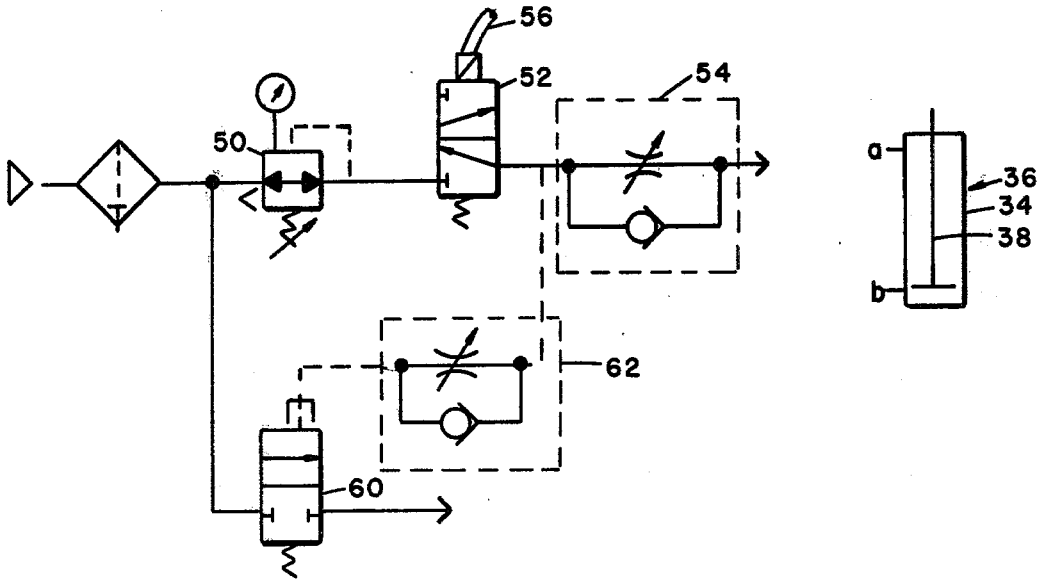

FIGS. 4*a* and 4*b* comprise an electrical schematic diagram depicting various features of the present control system;

FIG. 5 is an electrical schematic diagram depicting a power source for use in the control system of the present invention;

FIG. 6 is a schematic diagram of a pneumatic control system embodying various features of the present invention.

In accordance with the present invention, there is provided a control system for a stitching machine which in a preferred embodiment comprises a combination of electronics and pneumatics that in the automatic mode function selectively and serially independent of an operator following initiation, to provide for operation of a stitching machine uninterruptible by the operator for a preselected period of time to complete a given stitching operation. Following initiation of a stitching operation through actuation of the present control system, by affirmative operator action, the system internally of itself develops a plurality of interlocks that require the existence of selected conditions for continuation of "normal" machine operation and which respond to "abnormal" conditions by precluding machine operation past preselected termination points. In its semiautomatic mode, the present control system permits certain control by the operator, such as start, stop or speed of the stitching machine, but precludes operation under conditions that waste thread.

In a specific embodiment, the present system controls a stitching machine that is driven by means of the well-known motor-clutch-brake system in which the stitching mechanism is engaged with the drive motor through a clutch-brake mechanism that is biased toward a position of clutch disengagement and brake application. In this system the clutch and brake commonly are operated by means of a lever arm that is pivotably mounted to the motor housing. In the prior art, such lever arm is connected to a foot treadle that is operated by an operator to selectively activitate or deactivitate the stitching mechanism. In the present control system, when in the automatic mode, such foot treadle is disabled. In its place, the cylinder member of a pneumatic piston-cylinder device is connected rigidly to the lever arm that operates the clutch-brake mechanism. The piston member of the piston-cylinder device is disposed in juxtaposition to a solid, i.e., unyielding, surface such as the motor housing so that when the piston is extended it contacts the unyielding surface and urges the cylinder member toward a position wherein the lever arm causes the clutch to be engaged and the stitching machine to operate. As will be seen hereinafter, so long as air pressure is supplied to the piston-cylinder mechanism to extend the piston, the stitching machine remains operable. In the absence of such air pressure, the piston floats and the stitching machine is inoperative. Notably, the foot treadle has no effect on starting and stopping of the stitching machine when in the automatic mode. As will appear hereinafter, start-up of the stitching machine occurs where a work piece is in position for stitching and once started, the stitching machine continues to operate until certain circumstances obtain.

Start-up of the stitching machine occurs when light to a photodetector is blocked by a work piece in position in front of the needle and presser foot of the stitching machine. In the present control system, there is developed a reference electrical signal which has a normally assigned value just below the usual value of the electrical signal developed by the photodetector under conditions of ambient light with no blocking of the photodetector. The signal from the photodetector is compared to such reference signal and if higher (in the preferred embodiment), the system provides no air to the piston-cylinder device and the stitching machine remains idle. If the photodetector signal is lower than the reference signal, there is developed an electrical signal which is fed to a plurality of parallelly connected elements of the system, namely, a first-timing circuit, and 1st, 2nd, 3rd, and 4th NOR gates. The first timing circuit is connected in its monostable mode and when triggered by the signal from the photodetector develops a short duration pulse that is fed to a second timing circuit which serves as a total timer, that is, it is set to time out after a preselected total time of operation of the stitching machine following initial start-up. Once triggered, the total timer develops a high signal that is fed to a 5th NOR gate, said signal being inverted by the 5th gate and fed to the aforesaid 4th gate. This signal, plus the photodetector signal "open" the 4th gate to feed its high output signal to a 6th NOR gate. The output of this 6th gate is connected to a 7th NOR gate where such signal is paired with a further reference input signal to the 7th gate, and if a proper preselected result obtains, the output signal of the 7th gate, in turn, is fed eventually to a solenoid value that controls the flow of pressurized air to the piston-cylinder device. However, the 6th gate does not pass a proper signal to the 7th gate to develop a proper output signal therefrom until certain conditions obtain. Specifically, the second signal required to "open" the 6th gate is obtained from a proper combination of the output signals from the 3rd gate, an 8th NOR gate, and a 9th NOR gate, all of which feed their respective output signals, directly or indirectly, to an overrun timing circuit. This overrun timer is set to trigger when the trailing edge of the work piece passes the photodetector and the total timer has not timed out. This overrun timer is adjustable and is preset to provide an output signal therefrom to the 6th gate which results in opening of the same (and keeping the stitching machine operational) for a period of time following the completion of the stitching operation sufficient to run the stitching out a distance past the trailing edge of the work piece sufficient to permit cutting of the thread chain. This distance commonly is very short, i.e., less than one inch. Notably, the overrun timer will not be triggered unless the total timer has been triggered but has not timed out, so that the overrun timer, itself, cannot bring about actuation of the stitching machine. That is, the time cycle of the overrun time operates within the envelope time of the total timer to prevent false triggering of the stitching operation.

In the event the photodetector output signal to the total timer goes low (no work piece is blocking the light to the photodetector) between the time of triggering of the total timer and before it has timed out, such low signal is gated to trigger the overrun timer which provides a short time delay then turns off, hence dropping out the solenoid and closing off the pressurized air from the piston-cylinder device and stopping the stitching operation. This action also serves to reset all functions of the control system for commencement of a subsequent stitching operation.

In the semiautomatic mode of operation, all elements of the control system function as in the automatic mode, except the piston-cylinder device is positioned differently. For semiautomatic operation, the cylinder member is secured to the lever arm that operates the clutch-brake mechanism and the piston rod is connected to one end of a rigid rod whose opposite end is secured to the foot treadle (or directly to the treadle as desired). The source of pressurized air for the piston-cylinder device is connected to the cylinder in a manner such that when air is made available, the piston is urged toward its retracted position and becomes rigid with respect to the cylinder so that movement of the foot treadle results in movement of the "rigid" piston-cylinder device, hence movement of the lever arm. Thus, the operator is given control over when to start a stitching operation and in many instances control over the speed of stitching. However, despite her movement of the foot treadle, the present control system will not permit commencement of the stitching operation until a work piece is in position over the photodetector and ready for being stitched. Moreover, even though the operator holds the foot treadle down (machine run position), once the total timer has timed out, the solenoid drops out, air to the piston-cylinder device is closed off, and the piston "floats" in the cylinder to permit the lever arm to shut down the stitching machine.

Figure 1:
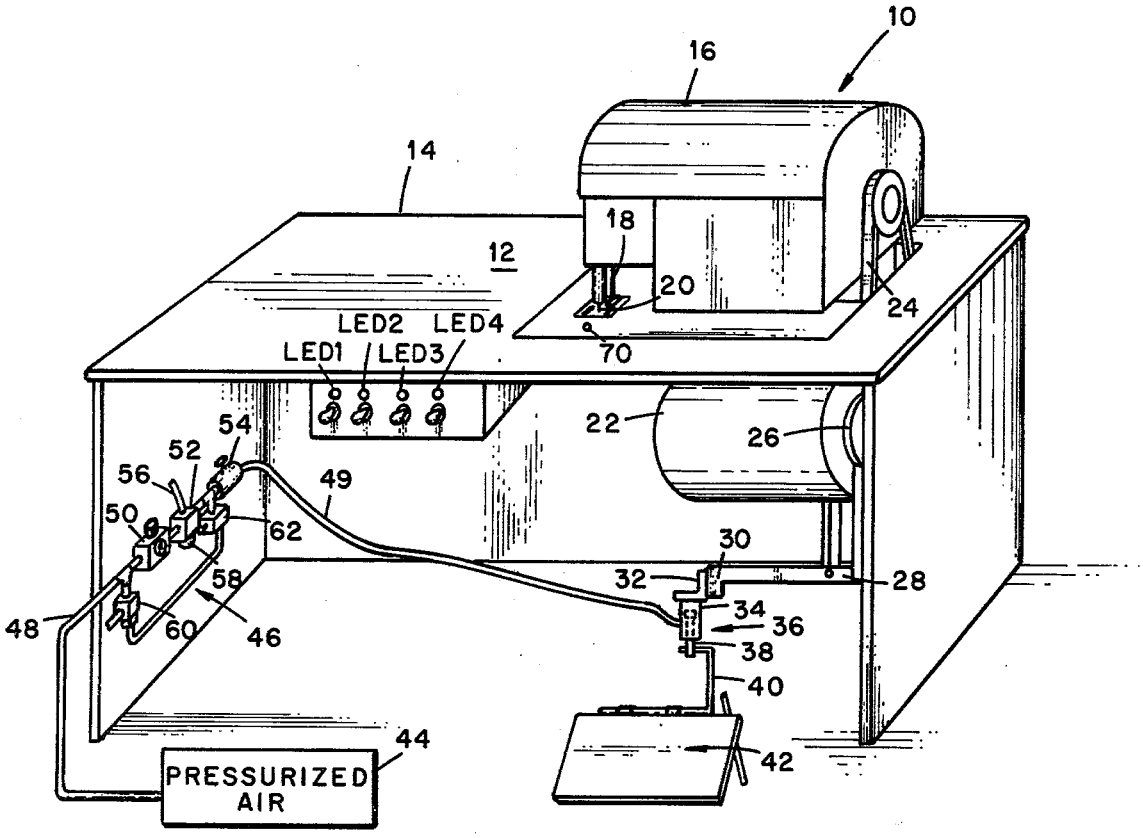
FIG. 1 is a representation of a stitching machine having incorporated therein a control system embodying various features of the invention.

With reference to the Figures, in FIG. 1 there is depicted an installation of one embodiment of the present control system on a Rimaldi chain stitch stitching machine 10. This stitching machine is mounted on the upper surface 12 of a stand 14 and includes a stitching head 16, a presser foot 18 and a needle 20. An electric motor 22 mounted under the stand serves to drive the stitching mechanism via a belt 24. The motor 22 is provided with a conventional brake-clutch mechanism 26 that is operable through the means of a lever arm 28 that is pivotally mounted on the motor housing. The outboard end 30 of the lever arm, in the embodiment depicted in FIG. 1 is arranged for the semiautomatic mode of operation, and has secured thereto, by means of a bracket 32, the cylinder member 34 of a pneumatic piston-cylinder device 36. The piston member 38 of the piston-cylinder device 36 is operably connected to a rigid rod 40 which, in turn is connected to a foot treadle 42. A source of pressurized air 44 is connected through a pneumatic control circuit 46 and conduits 48 and 49 to the piston-cylinder device in a manner such that when pressurized air is available to the device, the piston member 38 is retracted and is rigid with respect to the cylinder member 34. Under such conditions, movement of the foot treadle produces movement of the lever arm 28 and resultant operation of the stitching mechanism. When no air is provided to the piston-cylinder device, the piston member "floats" so that the foot treadle is disabled.

As shown in FIGS. 1 and 6, the flow of pressurized air to the piston-cylinder device 36 is regulated by the pneumatic circuit 46 which is connected by a conduit 48 to the source of pressurized air 44. Comprising the circuit 46 is a pressure regulator 50, a solenoid valve 52 and a flow control valve 54 which is connected to the piston-cylinder device as referred to above. The solenoid valve 52 is operably connected by an electrical lead 56 to the electrical portion of the present control system as will be described further hereinafter. This solenoid valve is also provided with a manual override 58 in a preferred embodiment. In addition, the depicted circuit 46 includes a vacuum control subassembly comprising a pneumatically actuated, pilot actuated valve 60, and a vacuum cutoff delay 62 so connected in the circuit 46 that when the solenoid valve 52 is open, air is made available through the vacuum cutoff delay to the valve 60 to open the same and permit the flow of air to a conventional vacuum generator flow control to provide vacuum for pulling cut thread to a waste collector as is well known in the art. Following shut down of the stitching machine, the vacuum cutoff delay 62 delays the closing of the valve 60 for a short period of time which is sufficient to ensure that any thread cut off at the end of the stitching operation is pulled into the waste collector.

Figure 2:
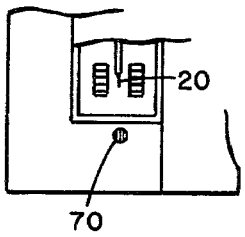
FIG. 2 is a fragmentary representation of the needle station of the stitching machine depicted in FIG. 1 and depicting the location of the photodetector element of the present invention.
Figure 3:
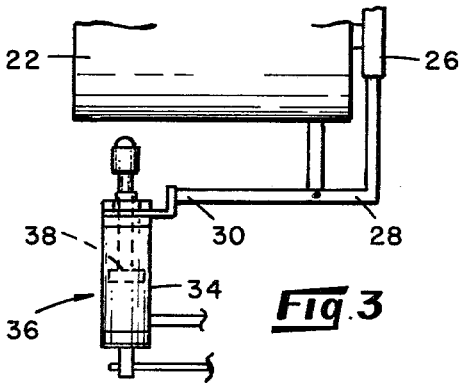
FIG. 3 is a fragmentary representation of a portion of the drive motor control element of the present invention.

In the electrical portion of the present control system there is provided a photodetector cell 70 (FIG. 2) embedded in the top 12 of the stand 14 at a location immediately in front of the needle and presser foot of the stitching machine. This cell 70 is exposed to ambient light and lies in the path to be followed by a work piece being fed into the stitching machine. Accordingly, the cell detects less light when a work piece is in position and develops a lesser output electrical signal than when there is no such work piece present covering the cell.

With reference to FIGS. 4*a* and 4*b* in particular, in a preferred embodiment the cell 70 comprises the collector-base junction of semiconductor PCI and is coupled to a high gain DC amplifier UIA which amplifies the output signal from the photodetector and feeds the same from its output through resistor R2 and capacitor C1 to the input side of a voltage comparator UIB having approximately 0.5 volts hysterises for good noise margin. The resistor R2 and capacitor C1 function as a ripple filter to remove any 60 hz. signal picked up from ambient room lighting. There is also fed into the input side of the voltage comparator UIB a reference electrical signal which is developed by resistors P1 and R3, such signal being adjustable in value and present at a value that is just below the output of the cell 70 under ambient lighting conditions. The two input signals to UIB are compared and the resultant signal is converted to a digital signal which is fed from the output of UIB through a resistor R5 to the input side of a further comparator UIC which is used as an invertor. UIC changes states as the signal from UIB passes through Vcc/2 in either direction. The reference signal input to UIC is established by the resistors R6 and R7 at Vcc/2 for noise immunity.

The output signal from UIC is fed simultaneously to a first timing circuit U5 and 1st, 2nd, 3rd and 4th NOR gates U2A, U2B, U3A and U2D, respectively. The first timing circuit U5 is set up in the monostable mode as a one shot buffer which produces a clean, symmetrical square wave pulse that serves to reset and trigger a second timing circuit U6. On the positive transition of the output signal from timing circuit U5, such signal is fed to the base of a semiconductor Q2 to turn on the same and ensure that the timing capacitor C3 is fully discharged. The negative transition of the output signal from U5 is AC coupled to the trigger and reset pins of the timing circuit U6 to trigger the same.

The second timing circuit U6 serves as a total time timer with its timing range adjustable by resistor P2. Once set, this timer establishes the maximum total time over which the stitching mechanism will continue to operate after being initially triggered. Once U6 times out, the stitching mechanism is disabled until U6 has been reset and retriggered.

The output signal from the second timing circuit U6 is fed simultaneously to 2nd gate U2B and a 5th NOR gate U2C. The signals from inverter U1C when the cell 70 is obstructed and the total timer U6 before it times out, keeps the 2nd gate U2B closed. If the cell remains obstructed after U6 times out, the output of the 2nd gate U2B goes high to provide a triggering signal to a third timing circuit U7. This third timing circuit is set up in the astable mode as a pulse generator and when triggered generates a 2 hz pulse train which is fed through the 1st gate U2A to pulse a semiconductor Q1 and a light emitting diode LED 1 (if cell 70 remains obstructed) to cause flashing of LED 1. Only after the cell 70 has been cleared and the circuitry reset will LED 1 stop flashing.

The output signal from the total timer U6 is fed also to the 5th gate U2C where it is inverted and fed to the 4th gate U2D. This input signal to U2D and the signal from the inverter U1C open the 4th gate to develop a signal that is fed to a 6th NOR gate U3D.

Simultaneously, the inverted output signal from the 5th gate U2C is fed to an 8th NOR gate U3B. This signal plus the output signal from the 3rd gate U3A (which latter signal is an inversion of the output signal from the inverter U1C) function to develop an output signal which is fed to a 4th timing circuit U8. Notably this 4th timing circuit can be triggered only while the total timer U6 remains active, i.e., has not timed out and if the cell 70 is unobstructed. Its timing cycle is adjustable by resistor P3 and it serves to establish a time period during which the stitching operation will continue following the passage of the trailing edge of a work piece past the cell 70 as the stitching operation is nearing completion. This time period is chosen to be sufficient in duration and ensures completion of the stitching operation (e.g., X additional stitches) plus sufficient length of thread chain to permit cutting of the chain.

As seen in FIG. 4*b*, specifically, the output signal from the 3rd gate U3A is fed also through a resistor R24 to the base of a semiconductor Q3 to turn on the same and ensure the full discharge of the timing capacitor C10. While the cell 70 is obstructed by a work piece, its output remains low, gate U3A inverts the same and supplies a high output to keep Q3 on and capacitor C10 fully discharged. When the trailing edge of the work piece passes the cell 70, light strikes the cell, driving its output high, gate U3A inverts to a low signal which is fed to 8th gate U3B. Since the total timer U6 has not timed out, its output signal is high, but is inverted to a low signal by the 5th gate U2C and fed to the 8th gate U3B. These two low signals open gate U3B to develop a high output signal therefrom which is fed to a 9th NOR gate U3C, inverted to a low signal and further fed to the trigger pin of the overrun timer U8. The output signal from the 8th gate U3B is fed to the reset pin of the overrun timer U8 and turns this pin off when the signal from gate U3B is high. During this transition, when the output signal from gate U3A goes low, Q3 is turned off.

The output signal from the overrun time U8 is high and is fed simultaneously to LED 2 to illuminate the same, and to the 6th gate U3D. Since the signal from the cell 70 is high at this point in time, the output signal from gate U2D being fed to gate U3D is low, however, pin 3 of the overrun timer holds the other input of U3B high so that the output signal from gate U3D remains low.

The output signal from the 6th gate U3D is fed to a 7th gate U4A. This gate is further selectively supplied by means of a manually operable switch SW2, with a second signal. When SW2 is closed, two low signals are fed to gate U4A causing its output signal to go high. This output signal is fed through a current buffer (gain) comprising a semiconductor Q4, to the base of a semiconductor Q5 (a power transistor) to turn on the same and activate an LED 3 and a solenoid SOL 1. In the present embodiment, activation of the solenoid SOL 1 opens the valve associated therewith to admit pressurized air to the piston-cylinder device 36.

A preferred power source for the depicted electrical portion of the present control system is shown in FIG. 5. The depicted power supply is a conventional 7812 Regulator which utilizes a source of 110 volt AC current to provide a highly regulated 12 volt DC output. As depicted in FIG. 5, the 110 volt AC current is fed through a transformer T1 and a bridge rectifier BR1 to a voltage regulator VR1, thence through a series of capacitors C12–C17 to provide the desired 12 volt DC output. It will be recognized, of course, that other AC inputs may be used.

In a typical operation of a stitching machine in the semiautomatic mode, employing the present control system, a work piece is positioned by the operator with its leading edge adjacent the presser foot and needle of the stitching machine with the material obstructing the cell 70. Thereupon, the electrical output of the cell is compared to the reference signal developed by the variable resistor P1 at the voltage comparator U1B. The output of this voltage comparator is in the form of a digital signal which is inverted and fed to the 1st NOR gate U2A, the 2nd NOR gate U2B, and the 4th NOR gate U2D and the 3rd NOR gate U3A and to the timing circuit U5.

At this point in time, the two signals received at the input of the 1st gate U2A are both low so that its output is high and LED 1 is on. The cell output signal which is simultaneously fed to the timing circuit U5 triggers the same to generate the symmetrical square wave input signal that is fed to the total timer U6 to trigger the same and produce an output signal therefrom which is high. This signal is fed simultaneously to the 2nd NOR gate U2B, thereby providing to this gate a high signal and a low signal so that its output remains low and the timing circuit U7 is not triggered. The output signal from the total timer is simultaneously fed to inputs of the 5th NOR gate U2C so that this high signal is inverted and the output from gate U2C becomes low. This low signal is fed as one input to the 4th gate U2D. Recalling that the 2nd input signal to the 4th NOR gate U2D comes from the cell 70 and is low at this point in time, these two low input signals open the 4th gate and provide a high output signal therefrom which is fed as one input into the 6th NOR gate U3D. The low output signal from the 5th NOR gate U2C is simultaneously fed to the 8th NOR gate U3B as one of the inputs thereto. The second input signal to the 8th gate U3B is high at this point in time, being derived from an inversion of the cell output by the third gate U3A. Accordingly, the output from U3B is low at this time and no resultant activity is generated in the overrun timer U8 by the 8th gate U3B. In like manner, the high output signal from gate U3A is fed to the base of semiconductor U3B to turn the same on and ensure the complete discharge of the overrun timer U8. Inasmuch as the triggering signal to the overrun timer U8 is low at this point in time, its output remains low so that the 6th gate U3D output also is low. This low output from the 6th gate is fed as one of the input signals into the 7th NOR gate U4A. The second input to the 7th gate is derived through the resistor R20 and switch SW2. The state of the signal developed when switch SW2 is closed is low so that both inputs to the 7th gate are low and its output is high which is then fed to the base of semiconductor 4 to turn on the same and provide an electrical signal of sufficient current value to turn on the semiconductor Q5 to activate LED 3 and the solenoid SOL 1. In this respect, it will be noted that when the switch SW2 is open, one of the input signals to the 7th gate goes high so that its output goes low and the solenoid is deactivated. Thus, the positioning of the switch SW2 at this location in the circuitry permits the entire circuitry ahead of the 7th gate to remain activated for maintenance, adjustment and analysis purposes without activation of the solenoid.

Should the work piece be removed from its blocking position over the cell 70, the electrical output signal of the cell 70 goes high to generally reverse each of the functions referred to above with the result that the first input to the 7th gate U4A from the 6th gate U3D goes high and the output of the 7th gate goes low as the overrun timer times out to turn off the solenoid SOL 1 thereby cutting off the source of pressurized air from the piston-cylinder device and causing the piston thereof to float thereby disengaging the stitching machine.

On the other hand, so long as the work piece stays in its blocking relationship to the cell 70, the machine will continue to operate until the total timer has timed out whereupon its output signal goes low with the result that the 1st input signal to the 7th gate goes high and its output goes low to deactivate the solenoid SOL 1 and stop the operation of the machine. Still further, should the work piece pass over the cell 70 prior to the timing out of the total timer U6, the cell output signal is reversed so that the input signals to the 8th gate U3B both are low and its output signal goes high to trigger the overrun timer U8. Thereupon the output signal from the overrun timer U8 goes high and is fed to the 6th gate U3D as one of the inputs thereof. Under these circumstances, both inputs into the 6th gate are high so that its output remains low and the machine continues in the operation until the overrun timer has timed out whereupon its output signal reverses and the solenoid SOL 1 is deactivated.

When the total timer U6 has timed out and its output signal goes low, and if the cell 70 remains obstructed, this results in two low inputs into the 2nd gate U2B so that its output goes high, thereby triggering the timing circuit U7 to provide a two hertz output pulse therefrom which is fed to the 1st gate U2A to turn off the LED 1 during each pulse. This resultant flashing of LED 1 tells the operator that the cell 70 is obstructed even though the machine is not operating as would be expected, and that a problem exists. By reason of the design of the present control circuit, retriggering of the several timing circuits occurs only after the cell 70 has been cleared and the overrun timer has timed out, which will be recalled to occur within the time cycle of the total timer U6. Therefore, the operator, if she is fast enough, can run successive work pieces through the stitching operation in a manner such that the total timer is activated at all times when in the fully automatic mode. However, once the work piece has passed over the cell 70 as when the trailing edge of the work piece passes over the cell as the completion of the stitching cycle end approaches, the overrun timer prevents the operator from running the machine continually without inserting a subsequent work piece into the machine.

As will be recognized from the foregoing description, when a work piece is in place over the cell 70 and the machine is operating, LED 1 will be lighted continuously. Likewise, when the machine is operating, that is when solenoid SOL 1 is activated, LED 3 will be lighted. Under these same conditions, LED 2, which is indicative of the activation of the overrun timer U8 will not be lighted. Therefore, the operator has a visual indication at all times of the status of the operability of the various elements of the control system. Moreover, as noted above, when the switch SW2 is open, the solenoid is deactivated to deactivate the stitching machine, but the electrical portion of the circuitry remains activated so that through the use of the LEDs, among other things, the operability of the various elements of the electrical portion of the control system may be checked. Further, when the electrical control system remains activated, appropriate adjustments, as necessary, may be made in the various adjustable elements of the circuit. Such adjustments are desirable especially when training new operators so that the total timer can be adjusted, for example, to provide longer times for the operator to complete a stitching operation. As the operator becomes more experienced, the total time of a stitching operation is reduced to that time which the operator has demonstrated to be the approximate maximum time for her to complete a stitching operation.

By reason of the capability of the present system to operate either in the automatic or semiautomatic mode by changing the position of the piston-cylinder device only, the single system can be used, by an inexperienced operator or in training a new operator who requires more control over the operation of the stitching machine during the learning process. Once the operator has become experienced, a relatively simple rearrangement of the piston-cylinder device as described above places the machine in the automatic mode of operation so that a more experienced operator can attain maximum production from the stitching machine.

Whereas a specific embodiment of the present control system has been described herein, it will be recognized that the present invention is to be limited only in accordance with the claims appended hereto. Specifically, whereas the present control system has been termed "electro-pneumatic", it will be recognized that the piston-cylinder device 36 can be operated by means of a pressurized fluid, such as a hydraulic fluid, so that the term "pneumatic" is intended to include "hydraulic."

What is claimed:

1. A control system for a stitching machine having means associated therewith for activating and deactivating the stitching mechanism thereof and comprising piston-cylinder means operatively associated with said means for activating and deactivating said stitching mechanism, a source of pressurized fluid, conduit means connecting said source of pressurized fluid to said piston-cylinder means, an electrically operated valve means interposed in said conduit means at a location between said source and said piston-cylinder means, electrical circuitry means suitable to provide an electrical signal to said valve means to selectively control the flow of pressurized fluid to said piston-cylinder means, said circuitry including detector means disposed in the path of a workpiece entering said stitching mechanism and providing an electrical signal that is representative, total timer means, overrun timer means operable within the time envelope of said total timer means, and gating means providing for the selective activation of said total timer means, said valve means, and said overrun timer means in response to said signal developed by said detector means.

2. The system of claim 1 wherein said piston-cylinder means is so positioned relative to said means for activating and deactivating said stitching mechanism that the introduction of pressurized fluid to said device effects activation of said stitching mechanism.

3. The system of claim 1 including treadle means and a clutch-brake mechanism and wherein said piston-cylinder means is connected between said clutch-brake mechanism and said treadle means and the piston member of said piston-cylinder means becomes rigid with respect to the cylinder member of said means when said valve means is actuated to admit pressurized fluid to said device so that movement of said treadle functions to activate said stitching mechanism.

4. A method for automatic control of a stitching machine having means for activating and deactivating the stitching mechanism of said machine, fluid actuated means operatively associated with said means for activating and deactivating said stitching mechanism, and electrically controlled valve means interposed between a source of pressurized fluid and said piston-cylinder device, the steps comprising developing a first electrical signal that is representative of the presence of a workpiece in position for stitching, directing said signal to a total timer set to time out after a preselected time period that is representative of the anticipated time required to complete a stitching operation, gating said signal to said valve means so long as said first signal exists but not longer than when the total timer has timed out, developing a second electrical signal that is representative of the absence of a workpiece in position for stitching, gating said second signal to an overrun timer if said total timer has not timed out to develop an output electrical signal therefrom, gating said output signal to said valve means until said overrun timer times out.

5. A method for controlling the length of thread used by a stitching machine between successive stitching operations on successive products comprising the steps of electro-optically detecting the presence of a leading edge of said product as such product is fed to said stitching machine to develop a first electrical signal, developing a reference signal, comparing said first electrical signal to said reference signal to develop a product signal that is representative of the presence of said leading edge of said product in position for commencement of a stitching operation thereon, feeding said product signal to first, second, third and fourth gates and to a first timing circuit, feeding said product signal simultaneously as one of the input signals to first, second, and fourth NOR gates and to a total timing circuit to develop an output signal from said timing circuit, feeding said product signal to a third NOR gate as both input signals thereto to develop an output signal therefrom which is an inversion of said product signal, feeding said inverted signal from said third gate to an eighth NOR gate as one of the inputs thereto, feeding said output signal from said total timing circuit to a fifth NOR gate as both inputs thereto to develop an output signal that is an inversion of said output signal from said total timing circuit, feeding said inverted signal from said fifth gate simultaneously to said fourth gate as one of the inputs thereto and to said eighth gate as one of the inputs thereto, feeding the output signal from said fourth gate to a sixth NOR gate as one of the input signals thereto, feeding the output signal from said eighth gate to an overrun timing circuit, feeding the output signal from said overrun timing circuit to said sixth gate as one of the input signals thereto, feeding the output signal from said sixth gate to a seventh NOR gate as one of the input signals thereto, developing a second reference signal and feeding the same to said seventh gate as one of the input signals thereto, said second reference signal being low relative to the other of the input signals to said seventh gate, feeding the output signal from said seventh gate to an electrically controlled valve means that is operatively associated with the stitching mechanism of said stitching machine.

6. A method for controlling the operation of the stitching mechanism of a stitching machine in a manner to conserve thread at the commencement of a stitching operation and upon the completion of stitching operation, said stitching machine being of the type in which the stitching mechanism is operated by a brake-clutch mechanism that is mechanically operated through the mechanism of a lever arm, and further including a piston-cylinder device operatively associated with said lever arm and an electrically operated valve means connected between a source of pressurized fluid and said piston-cylinder device, said method including the steps of:

disposing an electro-optical detector in position immediately ahead of the needle and presser foot mechanism of said stitching machine, developing a first electrical signal as the output from said detector means, said first signal being low when a workpiece is in position for stitching, developing a first reference signal which is high, comparing said first electrical signal and said reference signal to develop an output signal that is representative of the presence of a workpiece in position for stitching, feeding said output signal simultaneously to first, second and fourth NOR gates as a first input signal to each of the same, and to a third NOR gate as both of the input signals thereto, and to a first timing circuit set up to generate a short duration high electrical pulse when triggered, feeding the output signal from said first timing circuit to a total timing circuit as the input signal thereto for triggering such total timing circuit and to develop an output signal from said total timing circuit which is high, simultaneously feeding said output signal from said total timing circuit to said second gate as a second input signal thereto and to a fifth NOR gate as both of the input signals thereto whereby said fifth gate develops an output signal therefrom which in an inversion of the input signal thereto, feeding the output signal from said second gate to a second timing circuit which when triggered develops an output pulse train, the individual pulses of which are high, feeding said pulse train to said first gate as a second of the input signals thereto, feeding the output signal from said first gate to a lamp circuit in which the lamp is lighted when the input signals thereto are both low, feeding the output signal from said fifth gate simultaneously to said fourth gate as one of the input signals thereto and to an eighth NOR gate as one of the input signals thereto, feeding the output signal from said fourth gate to a sixth gate as one of the input signals thereto, feeding the output signal from said third gate to an eighth NOR gate as one of the input signals thereto, feeding the output signal from said eighth gate to an overrun timing circuit to trigger said timing circuit when said output from said eighth gate is high, thereby developing an output signal from said overrun timer which is high, feeding said output signal from said overrun timing circuit to said sixth gate as a second input signal thereto and simultaneously to a lamp which is lighted when said output signal from said overrun timer is high, feeding the output signal from said sixth gate to a seventh gate as one of the input signals thereto, developing a second reference which is low, feeding said second reference signal to said seventh gate as a second input signal thereto, feeding the output signal from said seventh gate to an electrically controlled valve to open said valve and admit pressurized fluid to said piston-cylinder device when said output signal from said seventh gate is high.

* * * * *